US006948916B2

(12) United States Patent
Hebert

(10) Patent No.: US 6,948,916 B2
(45) Date of Patent: Sep. 27, 2005

(54) PIPING LAYOUT FOR MULTIPLE COMPRESSOR SYSTEM

(75) Inventor: Thomas Hebert, Odessa, FL (US)

(73) Assignee: Global Energy Group, Inc., Plano, TX (US)

( * ) Notice: Subject to any disclaimer, the term of this patent is extended or adjusted under 35 U.S.C. 154(b) by 0 days.

(21) Appl. No.: 10/282,912

(22) Filed: Oct. 29, 2002

(65) Prior Publication Data

US 2003/0095871 A1 May 22, 2003

Related U.S. Application Data

(60) Provisional application No. 60/347,820, filed on Oct. 29, 2001.

(51) Int. Cl.[7] ..... F04B 17/00; F04B 35/00; F25B 43/02; F25B 1/10

(52) U.S. Cl. ..... 417/360; 417/902; 62/469; 62/510

(58) Field of Search ..... 417/360, 423.5, 417/313, 902, 63; 184/6.4, 6.16; 62/469, 510, 296; 285/179, 181, 131.1, 132.1

(56) References Cited

U.S. PATENT DOCUMENTS 3,140,041 A * 7/1964 Kramer et al. ..... 417/338
3,237,852 A * 3/1966 Shaw ..... 417/372
3,360,958 A * 1/1968 Miner ..... 62/470
3,386,262 A * 6/1968 Hackbart et al. ..... 62/469
3,785,169 A 1/1974 Gylland, Jr. ..... 62/468
4,102,149 A * 7/1978 Conley et al. ..... 62/196.2
4,277,955 A 7/1981 Parker ..... 62/510
4,383,802 A 5/1983 Gianni et al. ..... 417/12
4,569,645 A * 2/1986 Asami et al. ..... 418/63
4,750,337 A 6/1988 Glamm ..... 62/468
5,236,311 A 8/1993 Lindstrom ..... 417/254
5,277,554 A * 1/1994 Elson ..... 417/363
5,507,151 A * 4/1996 Ring et al. ..... 62/115
5,586,450 A 12/1996 Tollar ..... 62/192
5,839,886 A 11/1998 Shaw ..... 417/250

* cited by examiner

*Primary Examiner*—Timothy S. Thorpe
*Assistant Examiner*—Timothy P. Solak
(74) *Attorney, Agent, or Firm*—Burr & Brown

(57) ABSTRACT

A multiple hermetic compressor assembly comprising a first compressor and an adjacent, second compressor interconnected by a hot gas pressure discharge manifold, a suction gas pressure equalization manifold, a suction manifold and an oil equalization manifold, the manifolds including a plurality of the turns extending at right angles that minimizes vibrational-associated manifold stress failures by providing for adequate vibrational absorption in the manifolds and reduces hot gas discharge interference between the compressors.

11 Claims, 9 Drawing Sheets

Hot Gas Line Detail

Suction Equalization Line

Suction Line Details

Oil Equalization Line

PIPING LAYOUT FOR MULTIPLE COMPRESSOR SYSTEM

CROSS-REFERENCE TO RELATED APPLICATIONS

This application claims the benefit of Provisional Patent application Ser. No. 60/347,820, filed Oct. 29, 2001, the disclosure of which is hereby incorporated by reference herein.

BACKGROUND OF THE INVENTION

1. Field of the Invention

This invention pertains to a system for eliminating or at least minimizing vibration associated connection fractures of multiple hermetic compressors that are combined into a singly working manifold and single circuit.

2. Description of the Background Art

Presently, there exist many multiple hermetic compressor single circuit manifold compressor designs. These known multiple hermetic compressor manifold designs have known problems with vibrational related fracture failures, discharge gas interference, as well as oil level indication. When only one compressor, or less than all compressors, are running in these multiple compressor manifolds, there exists vibrational differences between the compressors which can cause fatigue fractures in hard coupled, short manifold connections. Also, the hot gas discharge of multiple compressors feeding into the same manifold can create additional vibration as well as interference between the discharge of the compressors.

Finally, oil level indicators have not been provided with manifolded hermetic compressors. Furthermore, during single compressor operation of a tandem or multi-compressor system, the oil in the inactive compressor drains through the oil equalization manifold into the active compressor, thereby creating an imbalance of too high of an oil level in the active compressor (and too low of an oil level in the inactive compressor). The high oil level in the active compressor results in excess oil flowing into the circulating refrigerant. Too much oil in the circulating refrigerant causes valve failure in reciprocating compressors due to the incompressibility of the liquid oil. Hence, there presently exists a need for assuring proper levels of oil are maintained in the tandem and other multi-compressor configurations.

In response to the realized inadequacies of these earlier multiple hermetic compressor manifold systems, it has become clear that there is a need for a multiple hermetic compressor manifold system that overcomes all of these mentioned deficiencies. The multiple hermetic compressor manifold system design must provide for adequate vibrational absorption between the multiple compressors. The present design must further provide for hot gas discharge interference between compressors to be minimized. Next, the present design must allow for oil level indication while assuring that proper levels of oil are balanced in the compressors so that oil from an inactive compressor does not excessively flow into and therefore flood the active compressor(s). Finally, the present design should lend itself to relatively easy single compressor replacement into the multiple hermetic compressor manifold. Inasmuch as the art consists of various types of multiple hermetic compressor single manifold circuit refrigeration systems, it can be appreciated that there is a continuing need for and interest in improvements to multiple hermetic compressors, single manifold circuit systems, and in this respect, the present invention addresses these needs and interests.

Therefore, an object of this invention is to provide an improvement which overcomes the aforementioned inadequacies of the prior art devices and provides an improvement which is a significant contribution to the advancement of multiple hermetic compressor manifold single circuit system designs.

Another object of this invention is to provide an improved multiple hermetic compressor manifold design for use in a refrigeration system that has all the advantages and none of the disadvantages of the earlier multiple hermetic compressor manifold designs.

Still another objective of the present invention is to provide a multiple hermetic compressor manifold design that minimizes or eliminates vibrational stress fractures in the manifold system.

Yet another objective of the present invention is to provide a multiple hermetic compressor manifold design that minimizes or eliminates discharge gas interference between compressors of the manifold set.

Still another objective of the present invention is to provide a multiple hermetic compressor design that includes an oil level indicator.

An additional objective of the present invention is to provide a multiple hermetic compressor manifold design that allows for single compressor replacement into the multiple hermetic compressor manifold.

Another object of the invention is to provide an oil level balancer for tandem and other multiple compressor systems so as to maintain a proper oil level in the compressor and preventing an active compressor from drawing excessive oil from an inactive compressor that would otherwise result in the excess oil circulating with the refrigerant and causing damage to the active compressor.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The present invention is defined by the appended claims with the specific embodiment shown in the attached drawings. The present invention is directed to an apparatus that satisfies the need for the advantages of an improved multiple hermetic compressor manifold system design. For the purpose of summarizing the invention, the invention comprises a piping manifold design that minimizes or eliminates vibrational associated manifold stress failures by providing for adequate vibrational absorption in the manifold piping system through improved design and materials. Further, pipe manifold design improvements provide for reduced hot gas discharge interference between compressors. Additionally, pipe manifold design improvements and the use of a site glass provide for oil level monitoring. Further, an oil level balancer is provided for maintaining a proper oil level in the compressors thereby preventing an active compressor from drawing excess oil from an inactive compressor. Finally, pipe manifold design and materials improvement provide for easy removal and replacement of a single compressor in the multiple hermetic compressor manifold system. Therefore, it can be readily seen that the present invention provides for improved reliability, use and maintenance. Thus, a multiple hermetic compressor manifold design of the present invention would be greatly appreciated.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more succinct understanding and of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

With reference to the drawings and in particular FIGS. 2, 3, 4, 5, 6 and 7 thereof, a new and improved multiple hermetic compressor parallel single circuit manifold assembly design embodying the principles and concepts of the present invention will be described.

Figure 1A:
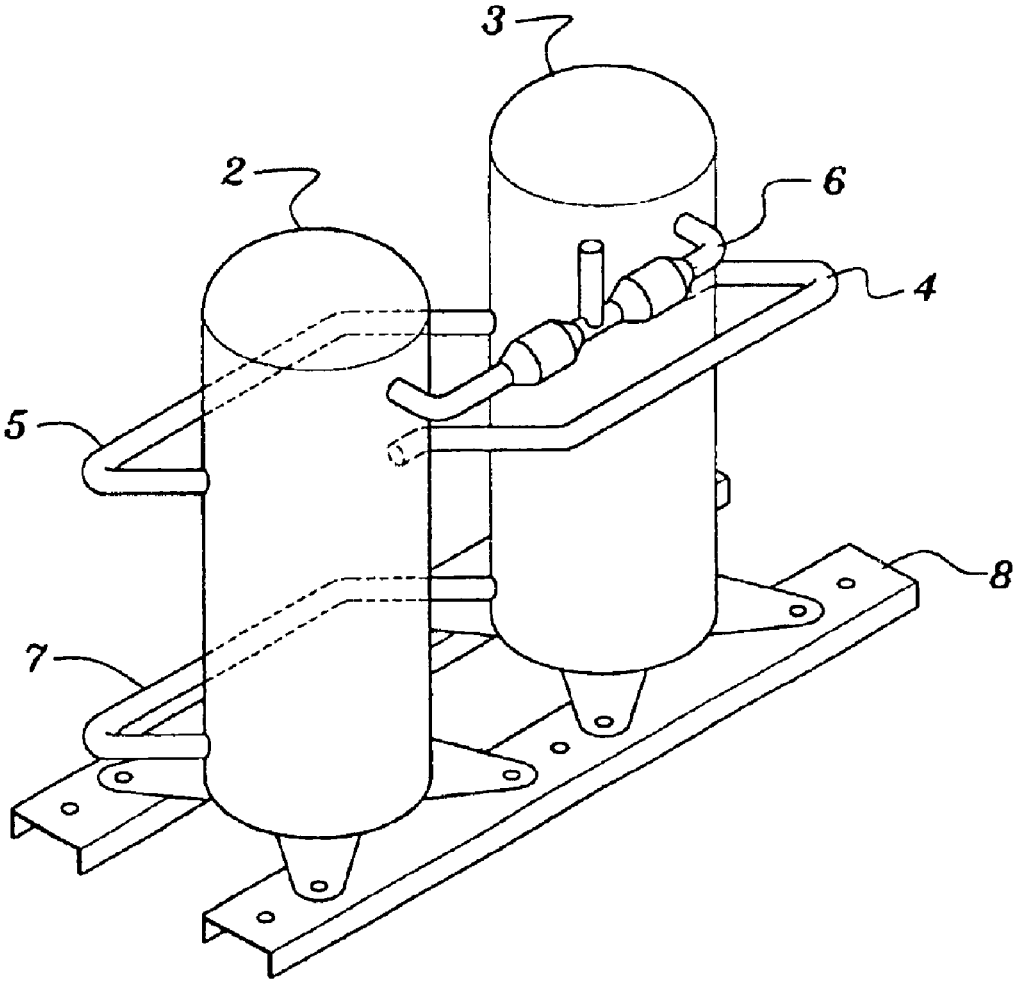
FIG. 1A (Prior Art)
FIGS. 1A and 1B are prior art illustrating a multiple, parallel single circuit hermetic compressor manifold system.
Figure 1B:
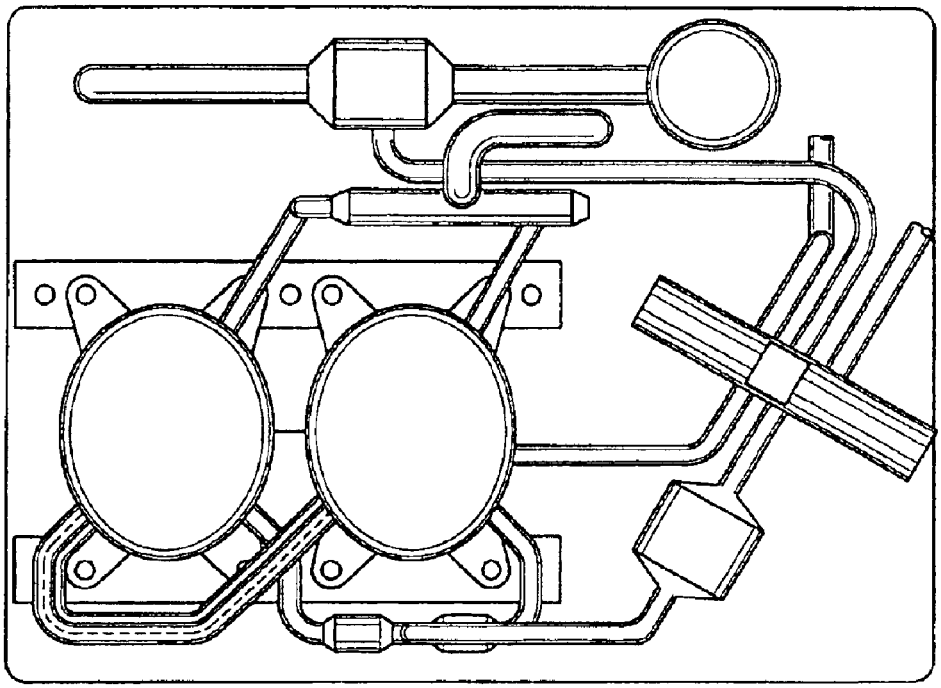
FIG. 1B (Prior Art)

As shown in FIG. 1, a multiple (dual in this case) hermetic compressor parallel single circuit assembly design of previously known design is illustrated, comprising a pair of hermetically sealed compressors 2 and 3, suction return manifold 4, suction equalization manifold 5, hot gas discharge manifold 6, oil equalization tube manifold 7, and rail support system 8.

Figure 2A:
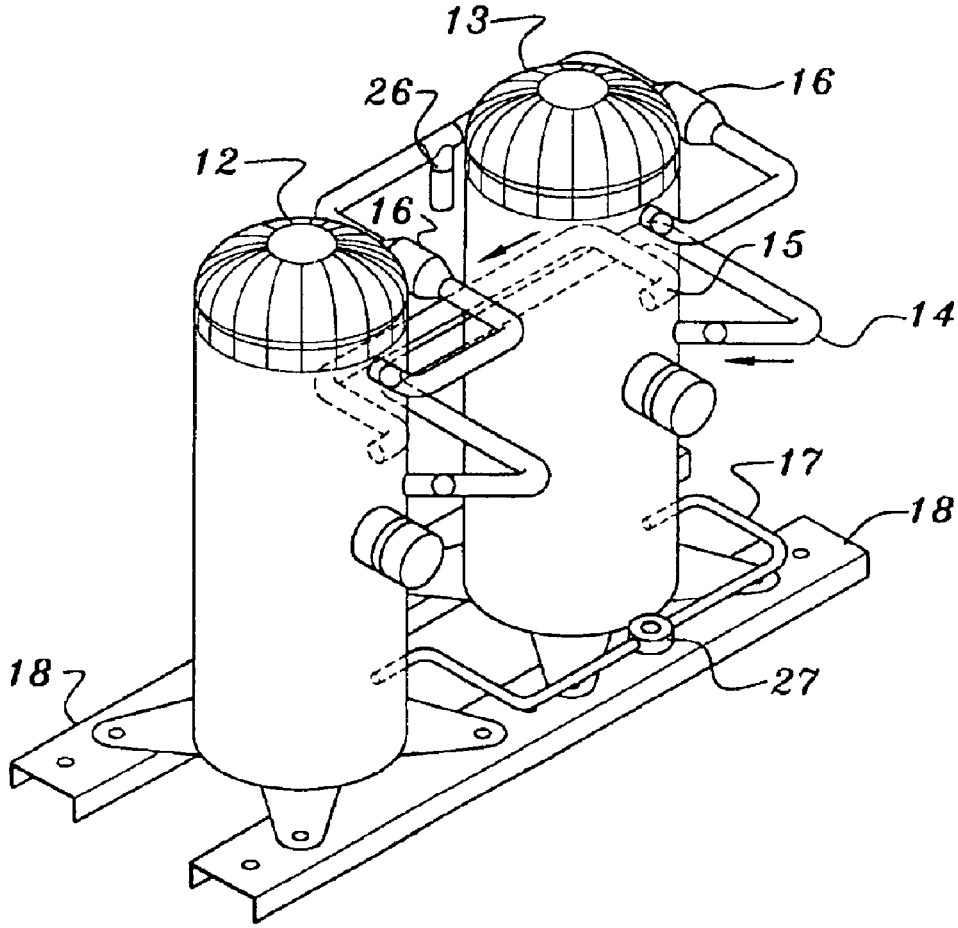
FIGS. 2A and 2B are illustrations of one embodiment of the present invention showing a dual parallel single current hermetic compressor manifold design of the new configuration.
Figure 2B:
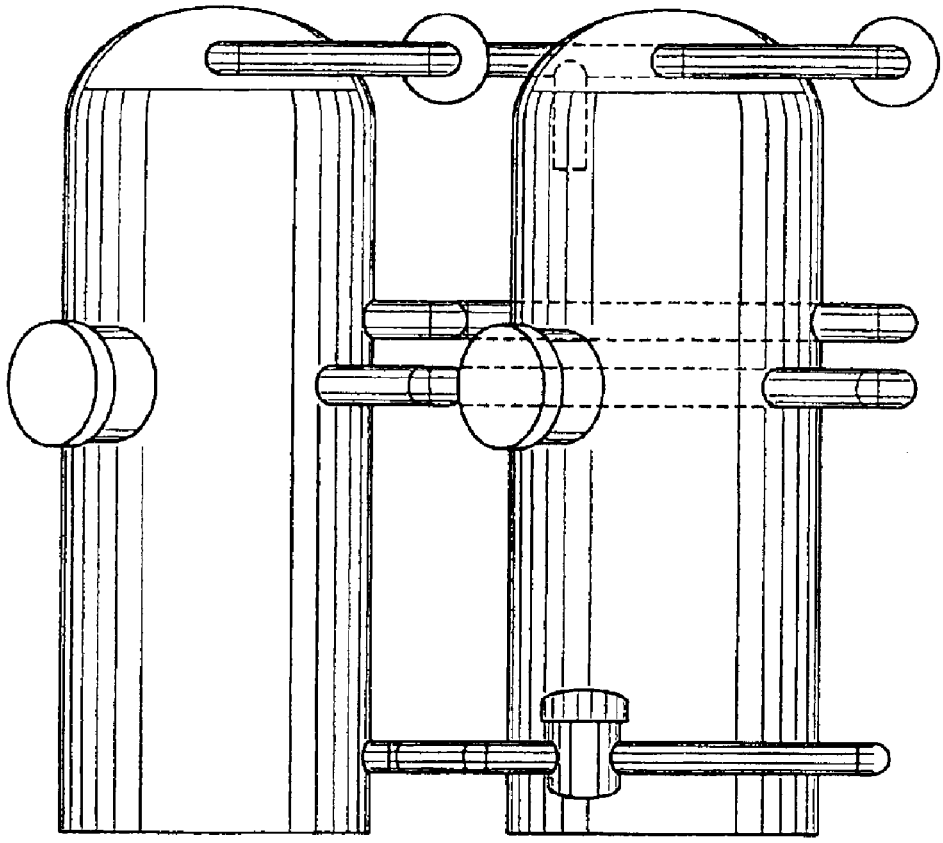

As shown in FIG. 2, the preferred embodiment of the present invention is shown in its entirety for a multiple (dual in this case) hermetic compressor parallel single circuit of improved design illustrated comprising a pair of hermetically sealed compressors 12 and 13, suction return manifold 14, suction equalization manifold 15, hot gas discharge manifold 16 with back pressure reducing wye 26, oil equalization manifold 17, with oil indicating site glass 27, and rail support system 18.

Figure 3:
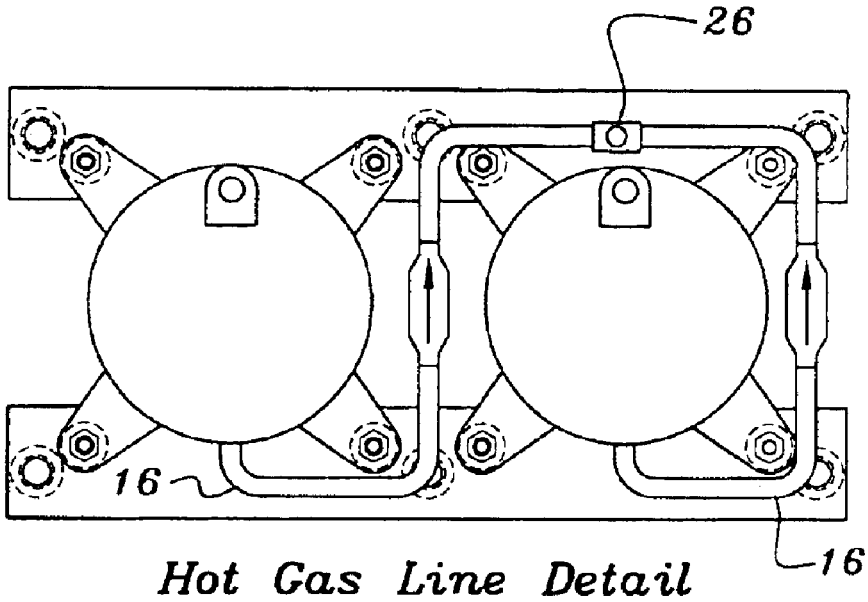
FIG. 3 is an illustration of one embodiment of the present invention showing only the hot gas manifold and check valve assembly portion of the new configuration for a dual parallel single current hermetic compressor manifold design.

As shown in FIG. 3, the preferred embodiment of just the hot gas pressure discharge manifold 16 and back pressure reducing wye 26 portion of the present invention are illustrated. Specifically, the hot gas pressure discharge manifold 16 extends substantially perpendicularly from a front portion of a first compressor 12, then turns at a substantially right angle to extend across the front portion, then turns at a substantially right angle to extend between the right side portion of the first compressor 12 and the left side portion of a second, adjacent compressor 13, then turns at a substantially right angle to extend across the rear portion of the second compressor 13, then turns at a substantially right angle to extend across the right side portion of the second compressor 13, then turns at a substantially right angle to extend across the front portion of the second compressor 13, then turns at a substantially right angle to extend perpendicularly into the front portion of the second compressor 13. Preferably, the back pressure reducing wye 26 is positioned within the portion of the manifold 16 that extends across the rear of the second compressor 13.

Figure 4:
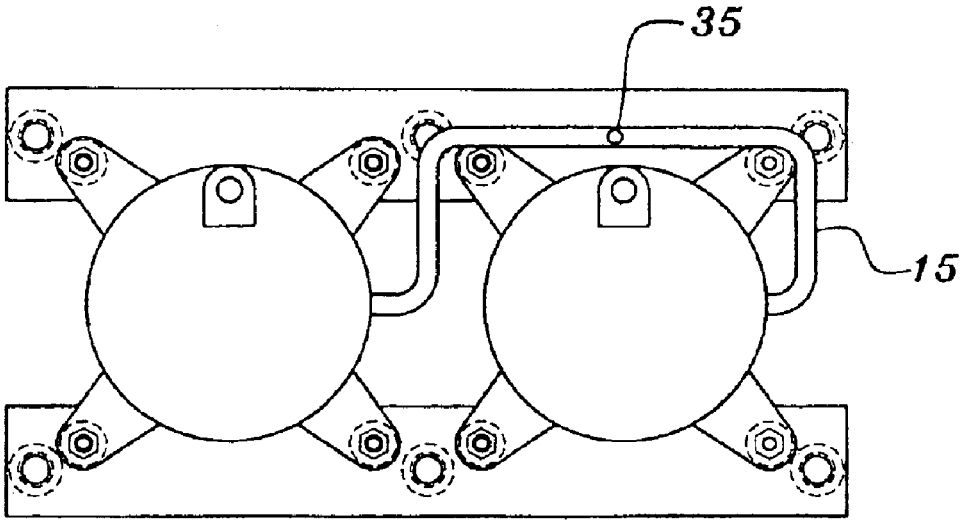
FIG. 4 is an illustration of one embodiment of the present invention showing only the suction gas pressure equalization manifold connection portion of the new configuration for a dual parallel single current hermetic compressor manifold design.

As shown in FIG. 4, the preferred embodiment of only the suction gas pressure equalization manifold 15 and oil changing port 35 portion of the present invention are illustrated. Specifically, the suction gas pressure equalization manifold 15 extends substantially perpendicularly from the right side portion of a first compressor 12, then turns at a substantially right angle to extend between the right side portion of the first compressor 12 and the left side portion of a second, adjacent compressor 13, then turns at a substantially right angle to extend across the rear portion of the second compressor 13, then turns at a substantially right angle to extend across the right side portion of the second compressor 13, then turns at a substantially right angle to extend perpendicularly into the right side portion of the second compressor 13. Preferably, the oil changing port 25 is positioned within the portion of the manifold 15 that extends across the rear of the second compressor 13.

Figure 5:
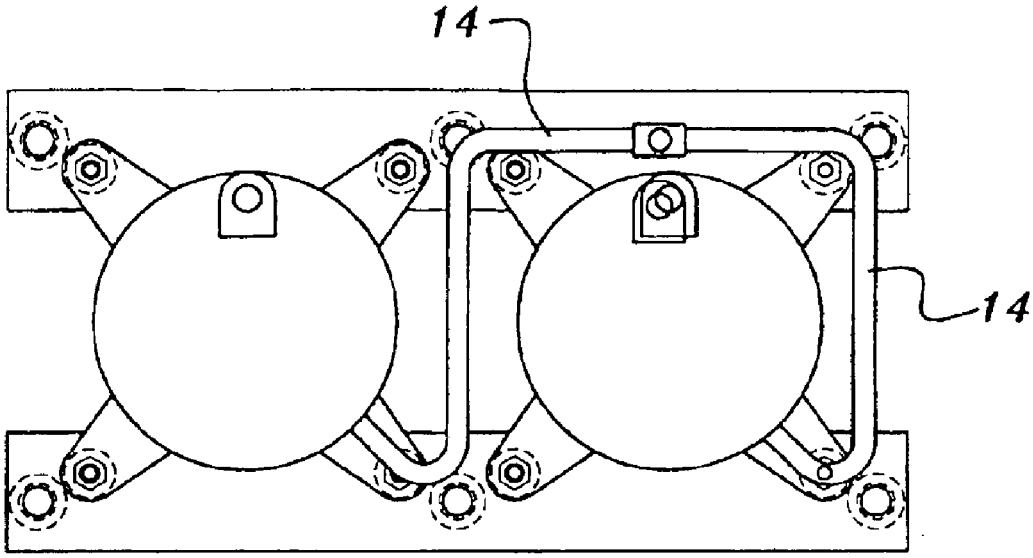
FIG. 5 is an illustration of one embodiment of the present invention showing only the suction return manifold assembly portion of the new configuration for a dual parallel single current hermetic compressor manifold design.

As shown in FIG. 5, the preferred embodiment of only the suction return manifold 14 portion of the present invention is illustrated. The suction return manifold 14 extends substantially perpendicularly from a front portion of a first compressor 12, then turns at a substantially acute angle to extend between the right side portion of the first compressor 12 and the left side portion of a second, adjacent compressor 13, then turns at a substantially right angle to extend across the rear portion of the second compressor 13, then turns at a substantially right angle to extend across the right side portion of the second compressor 13, then turns at a substantially acute angle to extend perpendicularly into the front side portion of the second compressor 13. Preferably, the downturned tee is positioned within the portion of the manifold 14 that extends across the rear portion of the second compressor 13.

Figure 6:
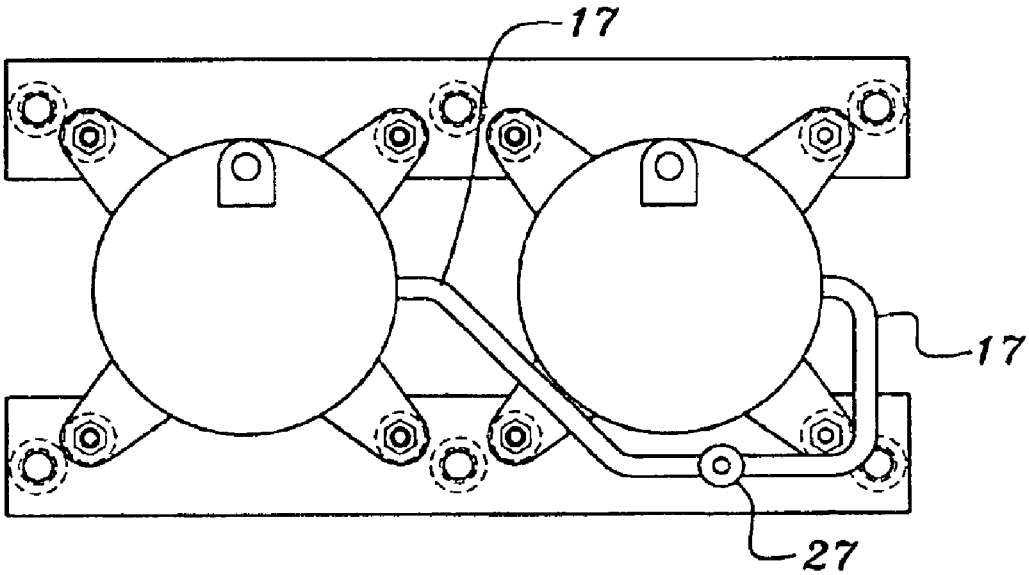
FIG. 6 is an illustration of one embodiment of the present invention showing only the oil equalization and oil level indicator manifold connection portion of the new configuration for a dual parallel single circuit hermetic compressor manifold design.

As shown in FIG. 6, the preferred embodiment of only the oil equalization manifold 17 and oil indicating site glass 27 portions of the present invention are illustrated. Specifically, manifold 17 extends substantially perpendicularly from a right side portion of a first compressor 12, then turns at a substantially obtuse angle to extend around the left side portion of a second, adjacent compressor 13, then turns at a substantially obtuse angle to extend across the front portion of the second compressor 13, then turns at a substantially right angle to extend across the right side portion of the second compressor 13, then turns at a substantially right angle to extend perpendicularly into right side portion of the second compressor 13. Preferably, the oil indicating sight glass 27 is positioned within the portion of the manifold 17 that extends across the front portion of the second compressor 13.

Figure 8A:
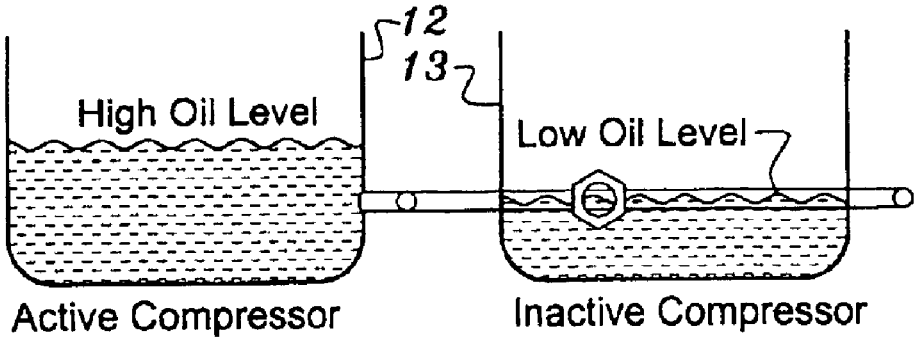
FIG. 8A is an illustration of the manner in which excess oil is drawn by an active compressor from an inactive compressor resulting in an excessive high oil level in the active compressor.

Referring to FIG. 8A, conventional oil equalization manifolds 17 fluidly interconnect the lower portion of tandem and other multiple compressor systems. During single compressor operation of such tandem or multi-compressor system, the oil in the inactive compressor (e.g., compressor 13) drains through the oil equalization manifold 17 into the active compressor (e.g., compressor 12), thereby creating an imbalance of too high of an oil level in the active compressor 12 (and too low of an oil level in the inactive compressor 13). The high oil level in the active compressor 12 results in excess oil flowing into the circulating refrigerant. Too much oil in the circulating refrigerant causes valve failure in reciprocating compressors due to the incompressibility of the liquid oil.

Figure 8B:
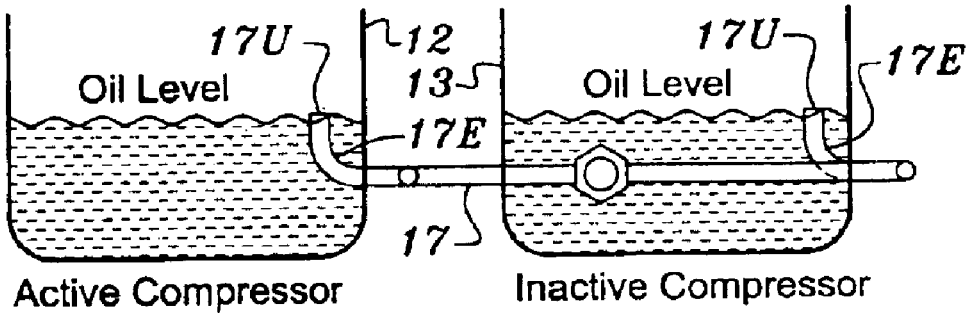
FIG. 8B is an illustration of the oil level balancer of the invention incorporated between tandem compressors to assure that the active compressor does not draw too much oil from the inactive compressor.

As reflected in FIG. 8B, the invention further comprises the manifold 17 with an upturned end 17E interiorly of the each compressors 12 and 13, respectively (or at least in the intended inactive compressor 13). Preferably, each of the upturned ends 17E forms substantially a right angle directed upwardly, the uppermost opening 17U of which sets the oil level in the compressor 12 or 13. In this manner, as the active compressor 12 operates, the oil level in the inactive compressor 13 can be at most drawn down by the active compressor 12 to the level set up the uppermost opening 17U of the manifold 17 extending into the inactive compressor 13. It is noted that the level of the respective uppermost openings 17U is factory-set to determine the desired oil level in the compressors 12 and 13, with the understanding that at least the corresponding fluid volume of oil is introduced during servicing into the respective compressors 12 and 13 to level-off with the uppermost openings 17U.

Figure 7A:
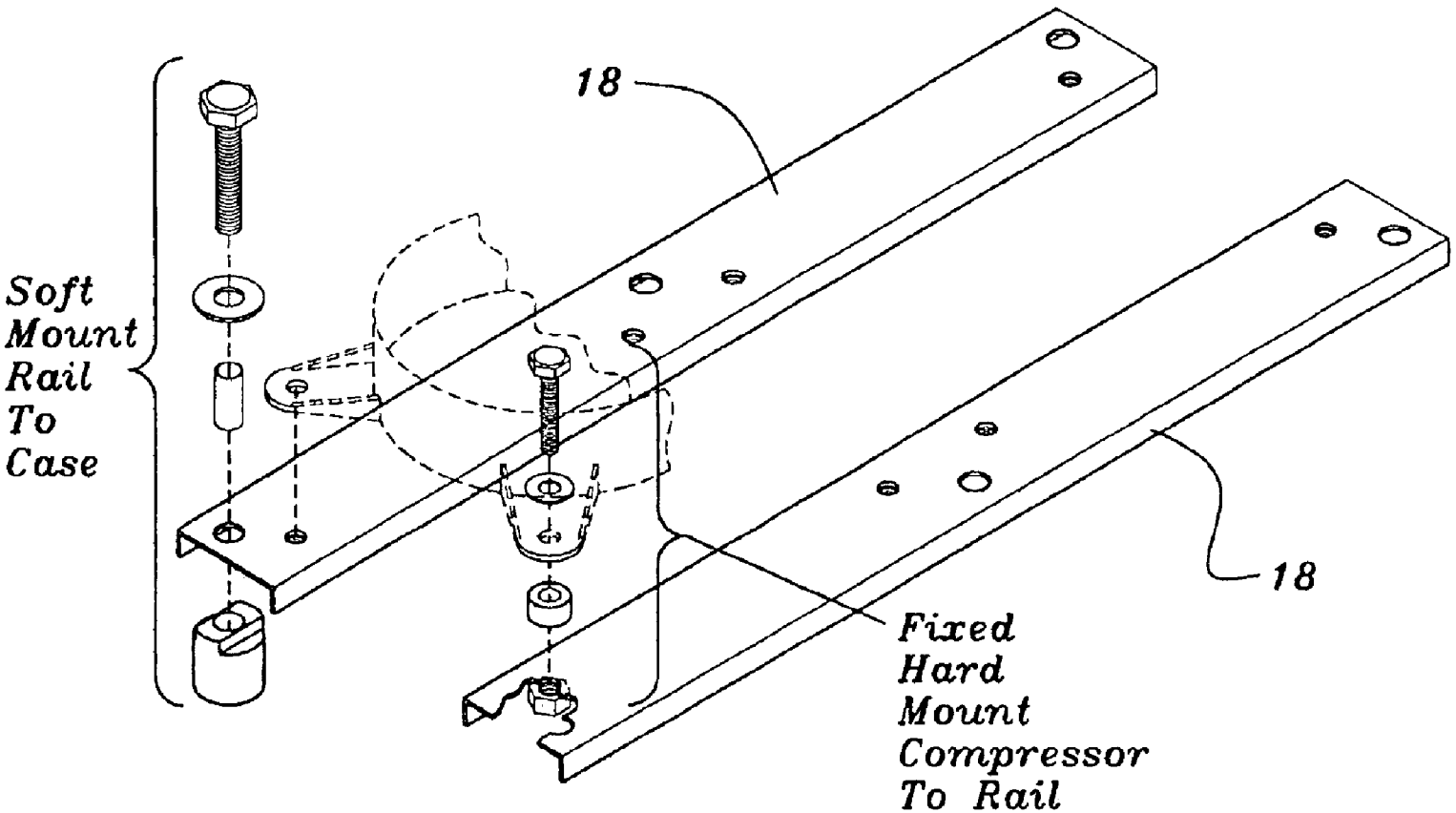
FIGS. 7A and 7B are illustrations of one embodiment of the present invention showing only the support rail assembly and mounting method for the compressor and rail assembly of the new configuration for a dual parallel single circuit hermetic compressor manifold design.
Figure 7B:
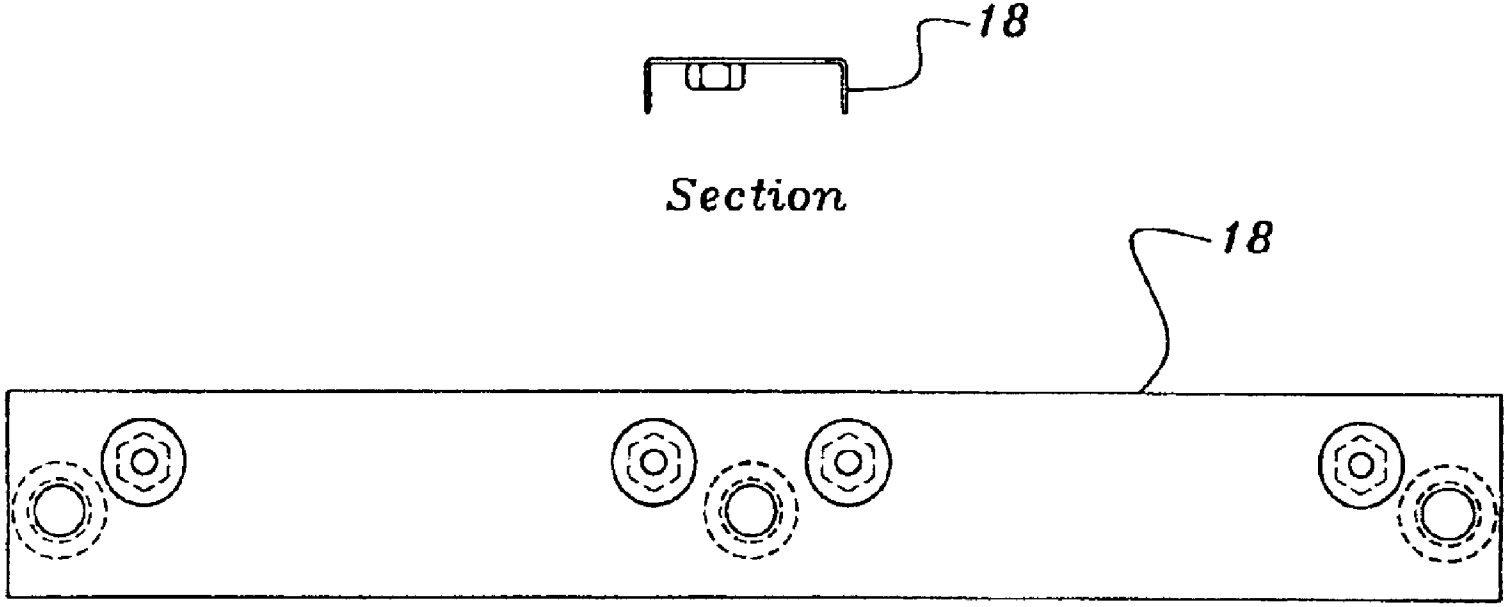

As shown in FIG. 7, the preferred embodiment of only the rail system 18 portion of the present invention is illustrated. The rail system 18 comprises two parallel angle iron rails mounted to the floor or base by a plurality of vibration absorbers.

Each compressor of a multiple hermetic compressor parallel single circuit assembly can operate singly or jointly. In the illustrations provided of a known multiple compressor manifold system see FIG. 1, compressor 2 can operate while compressor 3 is not operating or both compressor 2 and 3 can both be on at the same time. Moreover, a multiple compressor parallel single circuit assembly, up to N number of compressors could be operating simultaneously. This singly as well as simultaneous operation creates vibrational stresses between the compressors on the pipe connections between the compressors. Additionally, the discharge of compressor 2 into the hot gas discharge manifold 6 can create an increased back discharge pressure into compressor 3 that could cause hard starting problems for compressor 3. Next, oil level indication is not available with the dual compressor system oil equalization tube 7. Finally, compressor removal and replacement in the relatively rigid manifold system is extremely difficult.

In the preferred embodiment (FIG. 2), manifolds are constructed using a maximum number of turns as well as using vibration absorbing materials to limit rigid connections to a minimum thereby providing dampening action to incident vibrations. Further, a wye fitting 26 is used in lieu of a tee fitting on the hot gas discharge manifold to provide for smoother gas passage out of the manifold and to provide for less back pressure problems. This construction should provide for a venturi effect creating a lower back pressure than normal. Next, an oil level indicating site glass 27 is provided on the oil equalization manifold assembly 17 to provide a visual indication of oil level.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A multiple hermetic compressor assembly, comprising in combination:

a first compressor having a first side portion and an adjacent second side portion;

an adjacent second compressor having a third side portion, a fourth side portion, a fifth side portion and a sixth side portion, the third side portion of the second compressor facing the second side portion of the first compressor; and an oil equalization manifold extending from the second side portion of the first compressor, then turns to extend around the third side portion of the second compressor, then turns to extend across the sixth side portion of the second compressor, then turns to extend across the fifth side portion of the second compressor, then turns to extend into the second compressor.

2. The multiple hermetic compressor assembly as set forth in claim 1, wherein a plurality of the turns extend at a substantially right angle.

3. A multiple hermetic compressor assembly, comprising in combination:

a first compressor having a first side portion and an adjacent second side portion;

an adjacent second compressor having consecutively-positioned a third side portion, a fourth side portion, a fifth side portion and a sixth side portion, the third side portion of the second compressor facing the second side portion of the first compressor wherein the first side portion of the first compressor is adjacent to the sixth side portion of the second compressor;

a hot gas pressure discharge manifold extending from the first side portion of the first compressor, then turns to extend across the first side portion, then turns to extend between the second side portion of the first compressor and the third side portion of the second compressor, then turns to extend across the fourth side portion of the second compressor, then turns to extend across the fifth side portion of the second compressor, then turns to extend across the sixth side portion of the second compressor, then turns to extend perpendicularly into the sixth side portion of the second compressor.

4. The multiple hermetic compressor assembly as set forth in claim 3, wherein a plurality of the turns extend at a substantially right angle.

5. The multiple hermetic compressor assembly as set forth in claim 4, wherein all of the turns extend at a substantially right angle.

6. A multiple hermetic compressor assembly, comprising in combination:

a first compressor having a first side portion and an adjacent second side portion;

an adjacent, second compressor having a third side portion, a fourth side portion, a fifth side portion, a sixth side portion, the third side portion of the second compressor facing the second side portion of the first compressor wherein the first side portion of the first compressor is adjacent to the sixth side portion of the second compressor;

a hot gas pressure discharge manifold extending from the first side portion of the first compressor, then turns to extend across the first side portion, then turns to extend between the second side portion of the first compressor and third side portion of the second compressor, then turns to extend across the fourth side portion of the second compressor, then turns to extend across the fifth side portion of the second compressor, then turns to extend across the sixth side portion of the second compressor, then turns to extend perpendicularly into the sixth side portion of the second compressor;

a suction gas pressure equalization manifold extending from the second side portion of the first compressor, then turns to extend between the second side portion of the first compressor and third side portion of the second compressor, then turns to extend across the fourth side portion of the second compressor, then turns to extend across the fifth side portion of the second compressor, then turns to extend into the fifth side portion of the second compressor; and an oil equalization manifold extending from the second side portion of the first compressor, then turns to extend around the third side portion of the second compressor, then turns to extend across the sixth side portion of the second compressor, then turns to extend across the fifth side portion of the second compressor, then turns to extend into the second compressor.

7. The multiple hermetic compressor assembly as set forth in claim 6, wherein a plurality of the turns extend at a substantially right angle.

8. The multiple hermetic compressor assembly as set forth in claim 6, wherein a majority of the turns extend at a substantially right angle.

9. The multiple hermetic compressor assembly as set forth in claim 6, wherein the first and second side portions of the first compressor comprise front and right side portions, respectively, of the first compressor and wherein the third, fourth, fifth and sixth side portions of the second compressor comprise a left side, a rear side portion, a right side, and a front side portion, respectively, of the second compressor.

10. The multiple hermetic compressor assembly as set forth in claim 6, wherein the oil equalization manifold includes the upturned end extending into at least one of the first compressor and the second compressor.

11. The multiple hermetic compressor assembly as set forth in claim 10, wherein the oil equalization manifold includes the upturned end extending into both the first compressor and the second compressor.

* * * * *

UNITED STATES PATENT AND TRADEMARK OFFICE

CERTIFICATE OF CORRECTION

PATENT NO. : 6,948,916 B2
DATED : September 27, 2005
INVENTOR(S) : Thomas Hebert It is certified that error appears in the above-identified patent and that said Letters Patent is hereby corrected as shown below:

Column 6,
Line 1, change “see Fig. 1” to -- (see Fig. 1) --.

Column 8,
Line 31, add -- further -- after “manifold”.
Line 32, change the first occurrence of “the” to -- an --.

Signed and Sealed this

Twenty-fourth Day of January, 2006

JON W. DUDAS
*Director of the United States Patent and Trademark Office*